US005388284A

United States Patent [19]

Garnett

[11] Patent Number: 5,388,284

[45] Date of Patent: Feb. 14, 1995

[54] HIGH EFFICIENCY FLOATING THERMAL POOL COVER RETAINING DEVICE AND METHOD THEREFOR

[76] Inventor: Terry L. Garnett, 12694 E. Cortez Dr., Scottsdale, Ariz. 85259

[21] Appl. No.: 99,449

[22] Filed: Jul. 30, 1993

Related U.S. Application Data

[63] Continuation-in-part of Ser. No. 28,082, Mar. 8, 1993.

[51] Int. Cl.[6] ..... E04H 4/10

[52] U.S. Cl. ..... 4/503; 24/563

[58] Field of Search ..... 4/503, 504; 24/457, 24/543, 563

[56] References Cited

U.S. PATENT DOCUMENTS

| | | | |
|---|---|---|---|
| 2,260,584 | 10/1941 | Schuck et al. | 24/457 X |
| 2,751,653 | 6/1956 | Leibow | 24/563 X |
| 2,870,454 | 1/1959 | Schippert et al. | 4/503 |
| 3,959,854 | 6/1976 | Lewis | 24/563 X |
| 4,692,969 | 9/1987 | Johnson | 24/563 X |
| 4,946,065 | 8/1990 | Goulter et al. | 24/563 X |

FOREIGN PATENT DOCUMENTS

| | | | |
|---|---|---|---|
| 2214799 | 9/1989 | United Kingdom | 4/503 |

*Primary Examiner*—Charles E. Phillips
*Attorney, Agent, or Firm*—Harry M. Weiss

[57] ABSTRACT

A combination floating thermal pool cover and high efficiency thermal pool cover retaining device is disclosed having a flexible clamping portion for clinging to an extended edge of a pool and a retaining portion for lifting a small portion of the thermal pool cover off of localized turbulent surface areas of the pool created by underwater jets that can potentially remove larger portions of the thermal pool cover from contact with the surface area of the pool. By lifting small portions of the thermal pool cover off of these localized turbulent surface areas of the pool, the net effect is to maximize the total surface area of the thermal pool cover in communication with the pool surface. Moreover, by keeping the maximum amount of the thermal pool cover in contact with the water surface area of the pool, the pool water is heated more quickly and the amount of debris which falls into the pool is minimized.

18 Claims, 2 Drawing Sheets

HIGH EFFICIENCY FLOATING THERMAL POOL COVER RETAINING DEVICE AND METHOD THEREFOR

RELATED INVENTIONS

This application is a continuation in part of my earlier patent application entitled "Floating Thermal Pool Cover Retaining Device and Method Therefor" filed on Mar. 8, 1993, U.S. Ser. No. 08/028,082 by the same inventor of the subject patent application.

FIELD OF THE INVENTION

This invention relates generally to pool cover retaining devices and, more specifically, to a high efficiency floating thermal pool cover retaining device and method therefor which provides a self-securing device that simultaneously grips an extended edge of a pool and holds a portion of a floating thermal pool cover in place, in addition, several of these high efficiency floating thermal pool cover retaining devices are removably installed at several locations around the perimeter of the pool in order to lift a small portion of the thermal pool cover off of a localized turbulent surface area of the pool created by underwater jets that can potentially remove larger portions of the thermal pool cover, thereby, maximizing the surface area of the thermal pool cover in contact with the surface area of the pool.

DESCRIPTION OF THE PRIOR ART

Thermal pool covers provide several useful functions in the proper maintenance of a pool. As the name implies, thermal pool covers are designed to transfer and maintain heat in the water. In addition, these devices lessen the amount of dirt and debris that falls into the pool, thereby reducing the quantity of time and money that must be spent in order to preserve the cleanliness of the water. Thermal pool covers that are fabricated from colorful, decorative materials may also be selected in order to compliment the aesthetic quality of a pool patio area. However, in order to take advantage of the possible benefits offered by the use of a thermal pool cover, the maximum surface area of a pool should be covered by the thermal pool cover.

In the past, thermal pool covers were extremely limited in their ability to carry out the functions for which they were created. In general, thermal pool covers are layers of floatable material such as plastic which define an inner region filled with gas such as air. In practice, heat from the sun warms the air constrained within the layers of plastic which in turn slowly transfers its heat to the water in the pool, however, even under optimum conditions, it typically takes several days to raise the average temperature of the water in a pool by 5–10 degrees. Of course, there are many factors that influence the rate of heat transfer in this process, but by focusing on the contribution of the thermal pool cover to this process and holding other factors such as weather conditions constant, one will more quickly heat a pool by keeping the maximum surface area of the pool covered by the thermal pool cover. This is the case because the heat transfer per unit area of a thermal pool cover is roughly uniform. In other words, there is no portion of a thermal pool cover which warms pool water faster than any other portion of the same thermal pool cover; therefore, it stands to reason that the heat transfer process will occur in a faster, more efficient manner when the maximum pool water surface area is covered by the thermal pool cover.

In an effort to provide thermal pool covers that cover the entire water surface area of a pool, the surface area of prior art thermal pool covers was larger than the surface area of the pool. This created a serious problem for these prior art pool covers, namely what to do with the excess material of the pool cover. In most cases, after the water surface area of the pool was covered, the extra pool cover material was draped over the edge of the pool and then weighted down at several points around the perimeter of the pool. However, despite the best intended efforts, gusts of wind invariably lift the prior art pool covers along their unweighted portions, and consequently, lift substantial parts of the pool cover from the water. As the wind lifts the pool cover and flows across the surface of the pool, the temperature of the pool water tends to drop; furthermore, the wind entrains dirt and other foreign matter that falls into the pool. Obviously then, these actions tend both to slow the desired heat transfer process PATENT and raise the amount of time which must be spent to keep the pool clean.

In an attempt to overcome these noteworthy flaws associated with the prior art thermal pool covers, pool covers were cut to conform to the water surface area of the pool. In this instance, no extra pool cover material extends beyond the edge of the pool; nevertheless, this approach also has its problems. Many of today's swimming pools have automatic cleaning systems which direct pressurized jets of water toward dirt which has settled out on pool surface areas in order to stir up the dirt and then filter it out of the water. Oftentimes, the force of the water jets lifts thermal pool covers from the water surface area. As in the previous discussion regarding other prior art pool covers, when the pool cover is raised off of the water, the probability of having debris fall into the pool increases and the thermal pool cover heating process is slowed. The aforementioned pending patent application entitled "Floating Thermal Pool Cover Retaining Device and Method Therefor" provided a device and method that enabled a thermal pool cover to remain in direct contact with the surface of a pool in most cases, however, in one special case, a portion of the thermal pool cover could possibly tend to uncover the pool surface. In particular, when a pool cleaning device forces a stream of water toward the edge of a pool surface, a turbulent flow could possibly result in uncovering the pool surface.

Therefore, a need existed to provide a device that enabled a thermal pool cover to remain in contact with the maximum water surface area of the pool regardless of the presence or the absence of a turbulent water flow in the vicinity of the edge of a pool, thereby improving the ability of the pool cover to warm the pool water, to keep unwanted debris from the pool, and to improve the overall appearance of the pool area.

SUMMARY OF THE INVENTION

In accordance with one embodiment of this invention, it is an object of this invention to provide an improved floating thermal pool cover and thermal pool cover retaining device.

It is another object of this invention to provide an improved thermal pool cover retaining device having a flexible, self-securing clamping portion for gripping an edge of a pool.

It is a further object of this invention to provide an improved thermal pool cover retaining device having a retaining portion for lifting and gripping a portion of the improved thermal pool cover in place, thereby maximizing the surface area thereof in contact with the surface of the water in a pool having turbulent water flow in the vicinity of the pool edge.

BRIEF DESCRIPTION OF THE PREFERRED EMBODIMENTS

In accordance with one embodiment of this invention, a combination floating thermal pool cover and thermal pool cover retaining device is disclosed comprising, in combination, a thermal pool cover having a plurality of slits therein for use on a swimming pool, a thermal pool cover retaining device for the thermal pool cover comprising, clamping means for removably coupling the retaining device to a portion of an extending edge of the swimming pool, and retaining means integrally connected to the clamping means for insertion through one of the plurality of slits in the floating thermal pool cover to hold the thermal pool cover in place where the retaining means of the thermal pool cover retaining device comprises means for both gripping and lifting an end portion of the thermal pool cover to provide a positive grip on the thermal pool cover. In addition, the clamping means has biasing means for pre-stressing a portion of a first member to provide a force against an upper surface of the pool edge and a portion of a second member to provide a force against a bottom surface of the edge in order to secure the clamping means to both the upper and bottom surfaces of the edge. Moreover, a surface portion of both the first member and the second member have gripping means located thereon for providing an improved grip on both the upper and bottom surfaces of the pool edge. Furthermore, a portion of the retaining means is provided with pivotal member means for permitting in one position insertion of a portion of the retaining means into one of the plurality of slits and for permitting after pivoting the pivotal member to another position to facilitate lifting the end portion of the thermal pool cover.

In accordance with another embodiment of this invention, a method of operating a combination floating thermal pool cover and thermal pool cover retaining device is provided comprising the steps of providing a thermal pool cover having a plurality of slits therein for use on a swimming pool, providing a thermal pool cover retaining device for the thermal pool cover comprising the steps of providing clamping means for removably coupling the retaining device to a portion of an extending edge of the swimming pool, and providing retaining means integrally connected to the clamping means for insertion through one of the plurality of slits in the floating thermal pool cover to hold the thermal pool cover in place where the retaining means of the thermal pool cover retaining device comprises means for both gripping and lifting an end portion of the thermal pool cover to provide a positive grip on the thermal pool cover. This method also includes the step of providing the clamping means having biasing means for pre-stressing a portion of a first member to provide a force against an upper surface of the pool edge and a portion of a second member to provide a force against a bottom surface of the edge in order to secure the clamping means to both the upper and bottom surfaces of the edge. In addition, this method includes the step of providing a surface portion of both the first member and the second member to have gripping means located thereon for providing an improved grip on both the upper and bottom surfaces of the edge. This method further includes the step of providing a portion of the retaining means with pivotal member means for permitting in one position insertion of a portion of the retaining means into one of the plurality of slits and for permitting after pivoting the pivotal member to another position to facilitate lifting the end portion of the thermal pool cover.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENT

Figure 1:
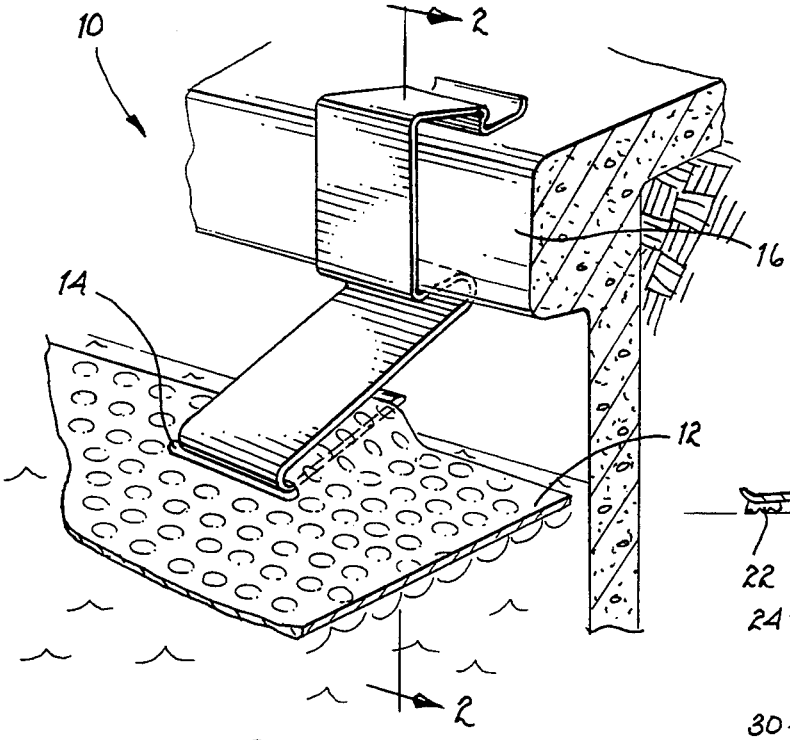
FIG. 1 is a perspective view showing one of the embodiments of the high efficiency floating thermal pool cover retaining device attached to an edge of a pool and gripping and lifting a portion of a thermal pool cover.

Referring to FIG. 1, a high efficiency thermal pool cover retaining device is generally designated by reference number 10. A portion of a floating thermal pool cover 12 having a slit 14 is kept in contact with the water surface area of a pool by the high efficiency thermal pool cover retaining device 10 which is attached along an edge 16 of the pool. In a manner similar to the connection of a single device 10 to a single slit 14 of the pool cover 12 as shown in FIG. 1, a plurality of these devices 10 would be used with a plurality of corresponding slits 14 to keep the pool cover 12 in place.

Figure 2:
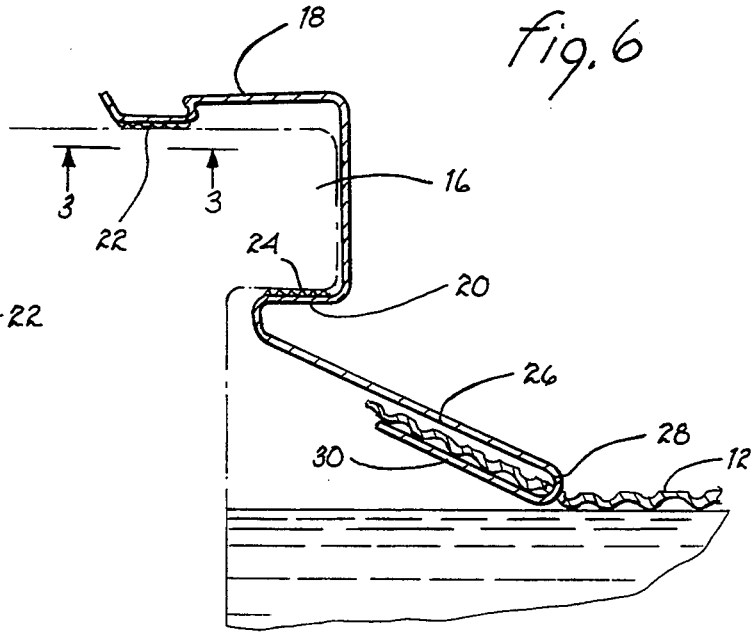
FIG. 2 is a cross sectional view of the high efficiency floating thermal pool cover retaining device taken along the line 2—2 of FIG. 1.

Referring to FIG. 2, the high efficiency thermal pool retaining device 10 is shown having a clamping portion for holding the device 10 to an edge 16 of the pool and having a retaining portion for insertion through a slit 14 in the thermal pool cover 12. The clamping portion includes a first member 18, a second member 20, and gripping portions 22 and 24. The clamping portion is pre-stressed so that the first member 18 provides a force against an upper surface of the pool edge 16 and the second member 20 provides a force against a bottom surface of the pool edge 16 in order to secure the device 10 to the pool edge 16. Note that the gripping portions 22 and 24 can be manufactured to have a rubber-like, serrated texture to improve the holding power of the device 10 to a pool edge 16. The retaining portion includes a downwardly sloped portion 26, a substantially U-shaped or connecting portion 28, and an upwardly sloped portion 30. The downwardly sloped portion 26, the substantially U-shaped portion 28, and the upwardly sloped portion 30 act, in combination, to both grip and lift a portion of the thermal pool cover 12 from the surface of the pool. By gripping and lifting a portion of the pool cover 12 from the pool surface, any water turbulence that might be caused in the vicinity of the perimeter of the pool by a pool cleaning system will not move the thermal pool cover 12, thereby covering the maximum surface area of the pool with the thermal pool cover 12.

Figure 3:
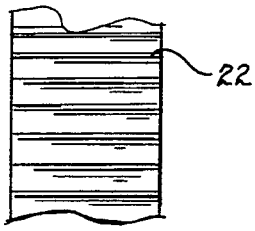
FIG. 3 is a cross sectional view a portion of the high efficiency floating thermal pool cover retaining device taken along line 3—3 of FIG. 2.

Referring to the cross-sectional view of the gripping portion 22 of FIG. 3, a rubber-like, serrated texture is shown which tends to improve the holding power of the device 10 to a pool edge 16.

Figure 4:
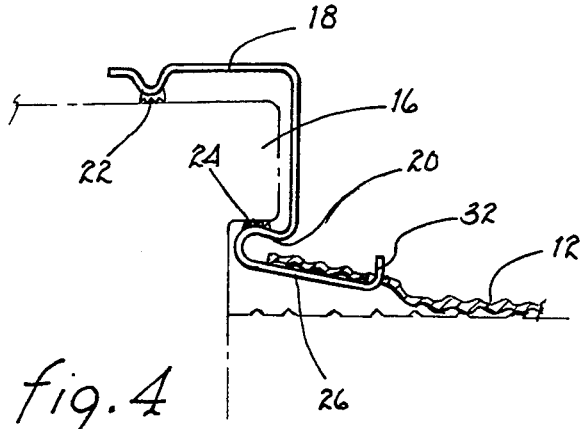
FIG. 4 is a side view showing another one of the embodiments of the high efficiency floating thermal pool cover retaining device attached to an edge of a pool and gripping and lifting a portion of a thermal pool cover.

Referring to FIG. 4, a side view of another one of the embodiments of the high efficiency floating thermal pool cover retaining device 10 is shown attached to an edge 16 of a pool. The high efficiency thermal pool cover retaining device 10 has a clamping portion for holding the device 10 to an edge 16 of the pool and a retaining portion for insertion through a slit 14 in a thermal pool cover 12. The clamping portion includes a first member 18, a second member 20, and gripping portions 22 and 24. The clamping portion is pre-stressed so that the first member 18 provides a force against an upper surface of the pool edge 16 and the second member 20 provides a force against a bottom surface of the pool edge 16 in order to secure the device 10 to the pool edge 16. The retaining portion includes a downwardly sloped portion 26 and a substantially J-shaped portion 32 which is located above the surface of the pool. The downwardly sloped portion 26 acts, in combination, with the substantially J-shaped portion 32 to both grip and lift a portion of the thermal pool cover 12 from the surface of the pool. More specifically, the J-shaped portion 32 is inserted through a slit 14 in the pool cover 12 so that a portion of the pool cover 12 may rest on a portion of the downwardly sloped portion 26.

Figure 4A:
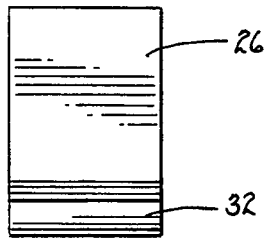
FIG. 4*a* is a cross sectional view of a retaining portion of the high efficiency floating thermal pool cover retaining device of FIG. 4.

Referring to FIG. 4*a*, a cross sectional view of part of the retaining portion of the high efficiency floating thermal pool cover retaining device 10 of FIG. 4 shows both the downwardly sloped portion 26 and the J-shaped portion 32.

Figure 5:
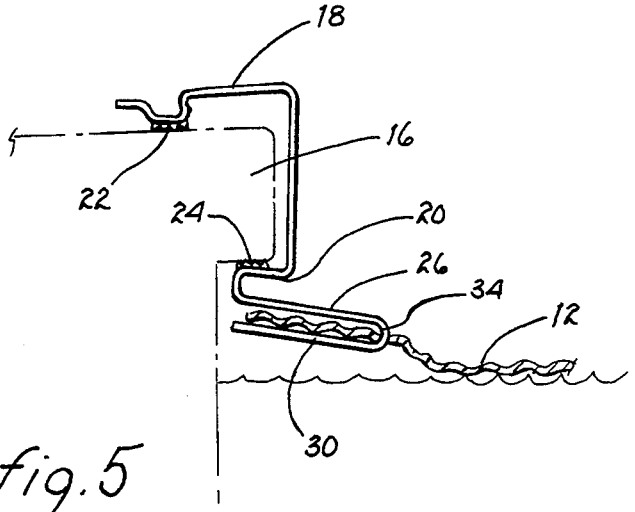
FIG. 5 is a side view showing yet another one of the embodiments of the high efficiency floating thermal pool cover retaining device attached to an edge of a pool and gripping and lifting a portion of a thermal pool cover.

Referring to FIG. 5, a side view of yet another one of the embodiments of the high efficiency floating thermal pool cover retaining device 10 is shown attached to an edge 16 of a pool. This embodiment of the high efficiency thermal pool retaining device 10 also has a clamping portion for holding the device 10 to an edge 16 of the pool and a retaining portion for insertion through a slit 14 in a thermal pool cover 12. The clamping portion includes a first member 18, a second member 20, and gripping portions 22 and 24. The clamping portion is pre-stressed so that the first member 18 provides a force against an upper surface of the pool edge 16 and the second member 20 provides a force against a bottom surface of the pool edge 16 in order to secure the device 10 to the pool edge 16. The retaining portion includes a downwardly sloped portion 26, a substantially U-shaped portion 34 which is located above the surface of the pool, and an upwardly sloped portion 30 which is also situated above the surface of the pool. The downwardly sloped portion 26 acts, in combination, with the substantially U-shaped portion 34 and the upwardly sloped portion 30 to both grip and lift a portion of the thermal pool cover 12 from the surface of the pool.

Figure 5A:
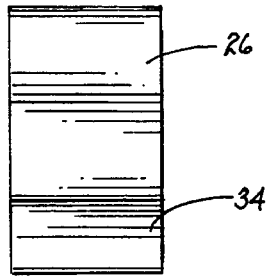
FIG. 5*a* is a cross sectional view of a retaining portion of the high efficiency floating thermal pool cover retaining device of FIG. 5.

Referring to FIG. 5*a*, a cross sectional view of part of the retaining portion of the high efficiency floating thermal pool cover retaining device 10 of FIG. 5 shows both the downwardly sloped portion 26 and the U-shaped portion 34.

Figure 6:
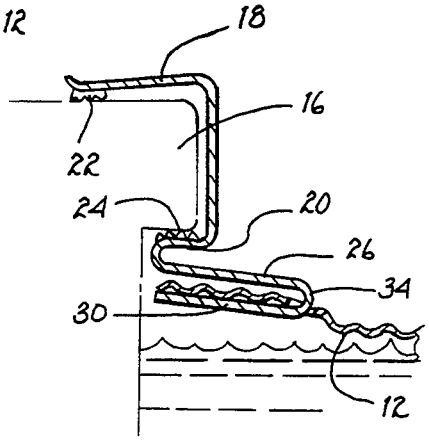
FIG. 6 is a side view showing still another one of the embodiments of the high efficiency floating thermal pool cover retaining device attached to an edge of a pool and gripping and lifting a portion of a thermal pool cover.

Referring to FIG. 6, a side view of yet another one of the embodiments of the high efficiency floating thermal pool cover retaining device 10 is shown attached to an edge 16 of a pool. This embodiment of the high efficiency thermal pool retaining device 10 is similar to the embodiment shown in FIG. 5 with a few substantial differences. In particular, the first member 18 of this embodiment is nearly linear whereas the first member 18 of FIG. 5 is substantially curved near the gripping portion 22. Also, the retaining portion of the embodiment shown in FIG. 6 is nearly parallel to the pool surface whereas the retaining portion of the embodiment in FIG. 5 has a clearly downward slope toward the pool surface.

Figure 7:
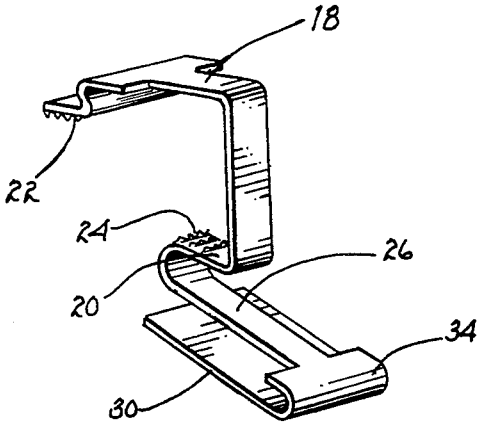
FIG. 7 is a perspective view of a further one of the embodiments of the high efficiency floating thermal pool cover retaining device showing how portions of the device are tapered.

Referring to FIG. 7, a perspective view of a further one of the embodiments of the high efficiency floating thermal pool cover retaining device 10 shows how portions of the device 10 may be tapered. In particular, portions of both the clamping and retaining portions are tapered in order to reduce the overall weight of the device 10. Note that this tapered feature could be integrated with any of the embodiments shown if such action was desired.

Figure 8:
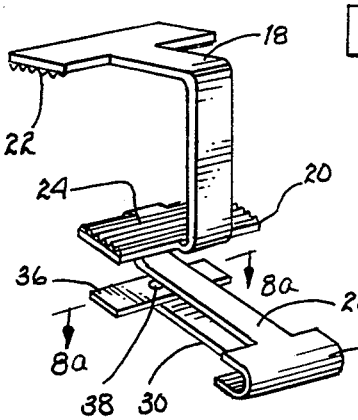
FIG. 8 is a perspective view of a still another one of the embodiments of the high efficiency floating thermal pool cover retaining device showing how some portions of the device are tapered and showing a pivotal member.

Referring to FIG. 8, a perspective view of yet another one of the embodiments of the high efficiency floating thermal pool cover retaining device 10 is shown. In this embodiment, parts of both the clamping and retaining portions of the device 10 are tapered in order to reduce the weight of the device 10. Also, note that the length of both the second member 20 and its associated gripping portion 24 is substantially increased to improve the holding strength of the device 10 to a pool edge 16. In this embodiment, the retaining portion includes a downwardly sloped portion 26, a substantially U-shaped portion 34 which is located above the surface of a pool (not shown), and an upwardly sloped portion 30 which also is situated above the surface of a pool. In addition, the retaining portion includes a pivotal member 36 and a connector 38 which allows the pivotal member 36 to be rotated.

Figure 8A:
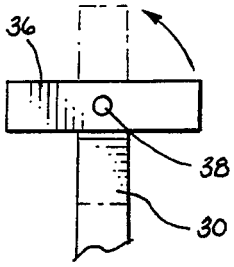
FIG. 8*a* is a cross sectional view of a portion of the pivotal member taken along the line 8*a*—8*a* a of FIG. 8.

Referring to FIG. 8*a*, a cross sectional view of a portion of the retaining portion of FIG. 8 demonstrates the versatility of the pivotal member 36. In a first position of the pivotal member 36 shown in phantom, the pivotal member 36 is aligned with the upwardly sloped portion 30 to permit the insertion of the retaining portion through a slit 14 in a pool cover 12. In this first position, the length of a slit 14 could be minimized since the pivotal member 36 would be aligned with the upwardly sloped portion 30. Once the retaining portion is inserted through a slit 14 in a pool cover 12, the pivotal member 36 can be rotated to the second position in which the pivotal member 36 is orthogonal to the upwardly sloped portion 30. In this second configuration, the pivotal member 36 is able to grip and lift a large portion of the pool cover 12.

OPERATION

The floating thermal pool cover 12 is first spread out over the surface area of the pool. The retaining portion of a high efficiency thermal pool cover retaining device 10 is then easily inserted through any one of the plurality of slits 14 located along the perimeter of the thermal pool cover 12. With the retaining portion installed, the clamping portion of the device 10 is adjusted to fasten to the pool edge 16. The above operation is repeated until all of the high efficiency pool cover retaining devices 10 have been installed, thereby providing a system which will keep the floating thermal pool cover 12 in contact with the maximum surface area of the pool.

While the invention has been particularly shown and described with reference to the preferred embodiments thereof, it will be understood by those skilled in the art that the foregoing and other charges in form and details may be made therein without departing from the spirit and scope of the invention.

I claim:

1. A combination floating thermal pool cover and thermal pool cover retaining device comprising, in combination:

a thermal pool cover having a plurality of slits therein for use on a swimming pool;

a thermal pool cover retaining device for said thermal pool cover comprising:

clamping means for removably frictionally coupling said retaining device to a substantially flat opposed surface portions of an extending edge of the swimming pool; and retaining means integrally connected to said clamping means for insertion through one of said plurality of slits in said floating thermal pool cover to hold said thermal pool cover in place, said retaining means of said thermal pool cover retaining device comprising means for both gripping and lifting including a portion extending downwardly from said clamping means, a connecting portion and a portion sloped upwardly toward said clamping means, said connecting portion connecting said portion extending downwardly to said portion extending upwardly, whereby when said clamping means is attached to the extending edge, and said upwardly extending portion is passed through one of said slits, said upwardly extending portion will retain an edge portion of said pool cover above the level of said connecting portion.

2. The device of claim 1 wherein said clamping means comprises a first member having a portion thereof in contact with a substantially flat upper surface of said edge and a second member integrally connected to said first member and having a portion thereof in contact with a substantially flat bottom surface of said pool edge.

3. The device of claim 2 wherein said clamping means having biasing means for pre-stressing said portion of said first member to provide a force against said substantially flat upper surface of said edge and said portion of said second member to provide a force against said substantially flat bottom surface of said edge in order to secure said clamping means to both said substantially flat upper and substantially flat bottom surfaces of said edge.

4. The device of claim 3 wherein a surface portion of both said first member and said second member have gripping means located thereon for providing an improved grip on both said substantially flat upper and substantially flat bottom surfaces of said edge.

5. The device of claim 4 wherein said gripping means comprising a serrated rubber coating.

6. The device of claim 1 wherein said connecting portion is a U-shaped portion located in proximity to a surface of said swimming pool.

7. The device of claim 1 wherein said connecting portion is a U-shaped portion located substantially above a surface portion of said swimming pool.

8. The device of claim 1 wherein a portion of each of said clamping means and said retaining means having a narrower portion than the remainder portion of each of said clamping means and said retaining means.

9. A combination floating thermal pool cover and thermal pool cover retaining device comprising, in combination:

a thermal pool cover having a plurality of slits therein for use on a swimming pool;

a thermal pool cover retaining device for said thermal pool cover comprising:

clamping means for removably coupling said retaining device to a portion of an extending edge of the swimming pool; and retaining means integrally connected to said clamping means for insertion through one of said plurality of slits in said floating thermal pool cover to hold said thermal pool cover in place, said retaining means of said thermal cover retaining device comprising means for both gripping and lifting an end portion of said thermal pool cover to provide a positive grip on said thermal pool cover; and wherein a portion of said retaining means is provided with pivotal member means for permitting in one position insertion of a portion of said retaining means into one of said plurality of slits and for permitting after pivoting said pivotal member to another position to facilitate lifting said end portion of said thermal pool cover.

10. A method of operating a combination floating thermal pool cover and thermal pool cover retaining device comprising the steps of:

covering a swimming pool water surface with a thermal pool cover having a plurality of slits therein;

retaining said thermal pool cover with a thermal pool cover retaining device for said thermal pool cover comprising the steps of:

clamping using clamping means for removably coupling said retaining device to a portion of an extending edge of the swimming pool; and retaining using retaining means integrally connected to said clamping means for insertion through one of said plurality of slits in said floating thermal pool cover to hold said thermal pool cover in place, said retaining means of said thermal pool cover retaining device comprising means for both gripping and lifting an end portion of said thermal pool cover to provide a positive grip on said thermal pool cover; and wherein a portion of said retaining means is provided with pivotal member means for permitting in one position insertion of a portion of said retaining means into one of said plurality of slits and for permitting after pivoting said pivotal member to another position to facilitate lifting said end portion of said thermal pool cover.

11. A method of operating a combination floating thermal pool cover and thermal pool cover retaining device comprising the steps of:

covering a swimming pool water surface with a thermal pool cover having a plurality of slits therein;

retaining said thermal pool cover with a thermal pool cover retaining device for said thermal pool cover comprising the steps of:

clamping using clamping means for removably frictionally coupling said retaining device to a substantially flat opposed surface portions of an extending edge of the swimming pool; and retaining using retaining means integrally connected to said clamping means for insertion through one of said plurality of slits in said floating thermal pool cover to hold said thermal pool cover in place, said retaining means of said thermal pool cover retaining device comprising means for both gripping and lifting including a portion extending downwardly from said clamping means, a connecting portion and a portion sloped upwardly toward said clamping means, said connecting portion connecting said portion extending downwardly to said portion extending upwardly, whereby when said clamping means is attached to the extending edge, and said upwardly extending portion is passed through one of said slits, said upwardly extending portion will retain an edge portion of said pool cover above the level of said connecting portion.

12. The method of claim 11 wherein said clamping means comprises a first member having a portion thereof in contact with substantially flat upper surface of said edge and a second member integrally connected to said first member and having a portion thereof in contact with a substantially flat bottom surface of said pool edge.

13. The method of claim 12 wherein said clamping means having biasing means for pre-stressing said portion of said first member to provide a force against said substantially flat upper surface of said edge and said portion of said second member to provide a force against said substantially flat bottom surface of said edge in order to secure said clamping means to both said substantially flat upper and substantially flat bottom surfaces of said edge.

14. The method of claim 13 wherein a surface portion of both said first member and said second member have gripping means located thereon for providing an improved grip on both said substantially flat upper and substantially flat bottom surfaces of said edge.

15. The method of claim 14 wherein said gripping means comprising a serrated rubber coating.

16. The method of claim 11 wherein a portion of each of said clamping means and said retaining means having a narrower portion than the remainder portion of each of said clamping means and said retaining means.

17. The method of claim 11 wherein said connecting portion is a U-shaped portion located in proximity to a surface of said swimming pool.

18. The method of claim 11 wherein said connecting portion is a U-shaped portion located substantially above a surface portion of said swimming pool.

* * * * *